US011407960B2

(12) United States Patent
Monden et al.

(10) Patent No.: US 11,407,960 B2
(45) **Date of Patent: *Aug. 9, 2022**

(54) LUBRICATING OIL COMPOSITION AND METHOD FOR PRODUCING SAME

(71) Applicant: SHOWA DENKO K.K., Tokyo (JP)

(72) Inventors: Ryuji Monden, Tokyo (JP); Yu Gao, Tokyo (JP); Kunio Kondo, Tokyo (JP); Masumi Kuritani, Tokyo (JP)

(73) Assignees: SHOWA DENKO K.K., Tokyo (JP); MITSUBISHI CORPORATION, Tokyo (JP)

( * ) Notice: Subject to any disclaimer, the term of this patent is extended or adjusted under 35 U.S.C. 154(b) by 134 days.

This patent is subject to a terminal disclaimer.

(21) Appl. No.: 16/758,115

(22) PCT Filed: Oct. 24, 2018

(86) PCT No.: PCT/JP2018/039444
§ 371 (c)(1),
(2) Date: Apr. 22, 2020

(87) PCT Pub. No.: WO2019/082915
PCT Pub. Date: May 2, 2019

(65) Prior Publication Data

US 2021/0371769 A1 Dec. 2, 2021

(30) Foreign Application Priority Data

Oct. 25, 2017 (JP) ..... JP2017-206644

(51) Int. Cl.
*C10M 177/00* (2006.01)
*C10M 125/02* (2006.01)
*C10M 169/04* (2006.01)
*C10N 70/00* (2006.01)

(52) U.S. Cl.
CPC ..... *C10M 177/00* (2013.01); *C10M 125/02* (2013.01); *C10M 169/04* (2013.01); *C10M 2201/041* (2013.01); *C10N 2070/00* (2013.01)

(58) Field of Classification Search
CPC ..... C10M 177/00; C10M 125/02; C10M 169/04; C10M 2201/041; C10M 159/12; C10M 2203/06; C10M 2203/1025; C10M 2205/0285; C10M 127/04; C10N 2070/00; C10N 2030/06; C10N 2040/14; C10N 2040/25
See application file for complete search history.

(56) References Cited

U.S. PATENT DOCUMENTS 5,292,444 A 3/1994 Patil et al.
5,454,961 A * 10/1995 Schriver ..... C10L 1/1683 508/184
5,462,680 A * 10/1995 Brois ..... C10M 127/00 508/110
5,611,824 A 3/1997 Stephens
6,573,224 B2 * 6/2003 McNeil ..... C10M 129/74 508/383
2008/0265203 A1 * 10/2008 Hwang ..... C10M 171/008 252/68
2010/0317767 A1 12/2010 Tanaka et al.
2011/0015106 A1 1/2011 Habeeb et al.
2012/0032543 A1 2/2012 Chakraborty et al.
2015/0162044 A1 * 6/2015 Hanawa ..... G11B 5/8408 360/75
2016/0347703 A1 12/2016 Igarashi et al.
2017/0009171 A1 1/2017 Soto-Castillo et al.
2019/0032971 A1 1/2019 Ishida et al.
2020/0339904 A1 10/2020 Monden et al.

FOREIGN PATENT DOCUMENTS

CN 101475866 A 7/2009
CN 102585973 A 7/2012
CN 103396865 A 11/2013
CN 105062618 A 11/2015
CN 105523924 A 4/2016
CN 106833807 A 6/2017
JP 2006-045350 A 2/2006
JP 2006-111509 A 4/2006
JP 2006-131874 A 5/2006
JP 2008026501 A * 2/2008 ..... G02B 13/0025
JP 2008-094656 A 4/2008
JP 2008-266501 A 11/2008
JP 2008266501 A * 11/2008
JP 2011-068899 A 4/2011
JP 2011068899 A * 4/2011
JP 2015129219 A * 7/2015
JP 2017-014192 A 1/2017
JP 2017-088757 A 5/2017
(Continued)

OTHER PUBLICATIONS

Dissolution of Fullerenes C60 and C70 in Organic Oils by Victor L Gerasimov and Ilya A Balay Materials Physics and Mechanics 20 (2014)33-36 (Year: 2014).*
Antiwear Effect of Fullerene C60 Additives in Lubricating Oils B M Ginzburg L A Shibaev OF Kireenko A A Shepelevskii M V Baidakova and A A Sitnikova Russian Journal of Applied Chemistry vol. 75 No. 8 2002 pp. 1330-11335 (Year: 2002).*
Dissolution of Fullerenes C60 and C70 in Organic Oils Victor I Gerasimove Ilya A balay Materials Physics and Mechanics 20 (2014) 33-36 (Year: 2014).*
International Search Report for PCT/JP2018/039444 dated Dec. 25, 2018 [PCT/ISA/210].
Extended European Search Report dated Jun. 22, 2021 from the European Patent Office in EP Application No. 18870167.6.
(Continued)

*Primary Examiner* — Pamela H Weiss
(74) *Attorney, Agent, or Firm* — Sughrue Mion, PLLC

(57) ABSTRACT

A method for producing a lubricating oil composition includes: a step of mixing a base oil and fullerene, dissolving a soluble component of the fullerene in the base oil, and obtaining a mixture of the base oil and fullerene; a step of removing an insoluble component included in the mixture and obtaining a fullerene solution; and a step of heat-treating the fullerene solution.

18 Claims, No Drawings

(56) References Cited

FOREIGN PATENT DOCUMENTS

| | | | | |
|---|---|---|---|---|
| JP | 2017-101169 | A | 6/2017 | |
| KR | 10-2006-0122342 | A | 11/2006 | |
| KR | 10-2014-0103523 | A | 8/2014 | |
| WO | 97/16510 | A1 | 5/1997 | |
| WO | WO-2014126315 | A1 * | 8/2014 | ..... C10M 169/04 |
| WO | 2016/063972 | A1 | 4/2016 | |
| WO | 2017/141825 | A1 | 8/2017 | |

OTHER PUBLICATIONS

Bon-Cheol Ku et al., "Tribological Effects of Fullerene (C60) Nanoparticles Added in Mineral Lubricants According to its Viscosity", International Journal of Precision Engineering and Manufacturing, Aug. 2010, vol. 11, No. 4, pp. 607-611 (5 pages).
Ning Dong et al., "Polymerization of Solid C60", Acta Physica Sinica, Apr. 1998, vol. 47, No. 4, pp. 632-644 (13 pages).
Hasina H. Ramanitra et al., "Synthesis of Main-Chain Poly(fullerene)s from a Sterically Controlled Azomethine Ylide Cycloaddition Polymerization", Macromolecules, 2016, pp. A-K (pp. 1681-1691; 11 pages).
Office Action dated Sep. 22, 2021, issued in Chinese Application No. 201880068860.5.
China National Intellectual Property Administration Office Action in Application No. 201880068465.7 dated Sep. 28, 2021 corresponding to U.S. Appl. No. 16/758,234; 10 pages total including translation.
Extended European Search Report dated Jul. 7, 2021 in Application No. 18869957.3 corresponding to U.S. Appl. No. 16/758,234.
International Search Report for PCT/JP2018/039454 dated Jan. 29, 2019 [PCT/ISA/210] corresponding to U.S. Appl. No. 16/758,234.
Liu Yuhong et al, "Tunable tribological properties in water-based lubrication of water-soluble fullerene derivatives via varying terminal groups", Chinese Science Bulletin, vol. 57, No. 35, Dec. 2012, pp. 4641-4645, (5 pages total).
Office Action dated Nov. 23, 2020 in U.S. Appl. No. 16/758,234.
Notice of Allowance dated Aug. 9, 2021 in U.S. Appl. No. 16/758,234.
Corrected Notice of Allowability dated Sep. 13, 2021 in U.S. Appl. No. 16/758,234.
Corrected Notice of Allowability dated Nov. 24, 2021 in U.S. Appl. No. 16/758,234.
Office Action dated May 28, 2021 in U.S. Appl. No. 16/758,234.

* cited by examiner

LUBRICATING OIL COMPOSITION AND METHOD FOR PRODUCING SAME

CROSS REFERENCE TO RELATED APPLICATIONS

This application is a National Stage of International Application No. PCT/JP2018/039444 filed Oct. 24, 2018, claiming priority based on Japanese Patent Application No. 2017-206644 filed on Oct. 25, 2017, the contents of which are incorporated herein by reference.

TECHNICAL FIELD

The present invention relates to a lubricating oil composition and a method for producing the same.

BACKGROUND ART

In recent years, along with the increase in speed and efficiency, and energy saving, there is a strong demand for performance improvement of lubricating oils that are used in automobiles, home electric appliances, industrial machines, and the like. Various additives such as an oxidation inhibitor, an extreme pressure additive, a rust inhibitor, and a corrosion inhibitor are incorporated into lubricating oils in order to improve the characteristics so as to be suitable for the use. On the other hand, in view of safety, there is a demand for a lubricant having a high flash point.

In order to respond to these demands, there is known an additive composition for engine lubricating oil obtained by incorporating fullerenes as nano-carbon particles, an organic solvent, a viscosity index improver, a friction modifier, and a detergent dispersant into a lubricating base oil such as a mineral oil or an ester oil, in order to simultaneously improve a plurality of performances such as low friction, increased torque, and increased fuel efficiency (see, for example, Patent Document 1).

Furthermore, there is also known a technology for suppressing friction and abrasion of a refrigerant compressor by adding fullerene particles having a diameter of 100 pm to 10 nm to a refrigerating machine oil that lubricates a sliding part of the refrigerant compressor (see, for example, Patent Document 2).

CITATION LIST

Patent Literature

[Patent Document 1]
Japanese Unexamined Patent Application, First Publication No. 2008-266501
[Patent Document 2]
PCT International Publication No. WO 2017/141825

SUMMARY OF INVENTION

Technical Problem

However, in the inventions described in Patent Document 1 and Patent Document 2, a sufficient effect was not obtained in view of an improvement in abrasion resistance.

The present invention was achieved in view of the above-described circumstances, and an object of the invention is to provide a lubricating oil composition that improves abrasion resistance, and a method for producing the same.

Solution to Problem

[1] A method for producing a lubricating oil composition, the method including: a step of mixing a base oil and fullerene, dissolving a soluble component of the fullerene in the base oil, and obtaining a mixture of the base oil and fullerene; a step of removing an insoluble component included in the mixture, and obtaining a fullerene solution; and a step of heat-treating the fullerene solution.

[2] The method for producing a lubricating oil composition as described in [1], wherein the step of heat-treating the fullerene solution is carried out in a low oxygen atmosphere.

[3] The method for producing a lubricating oil composition as described in [2], wherein the oxygen concentration in the fullerene solution is adjusted to 10 ppm by mass or less.

[4] The method for producing a lubricating oil composition as described in any one of [1] to [3], wherein in the step of heat-treating the fullerene solution, the heating temperature and the heating time for the fullerene solution are determined, based on a calibration curve showing the relationship between the concentration of the fullerene in the fullerene solution and the heating time for the fullerene solution, the calibration curve having been produced by measuring the concentration of the fullerene in the fullerene solution in a heated state at regular time intervals.

[5] The method for producing a lubricating oil composition as described in any one of [1] to [4], wherein the fullerene is a mixture including $C_{60}$ and $C_{70}$.

[6] The method for producing a lubricating oil composition as described in any one of [1] to [5], further including, after the step of removing an insoluble component or after the step of heat-treating the fullerene solution, a step of diluting the fullerene solution obtained in the step of removing the insoluble component, or the lubricating oil composition obtained in the step of heat-treating the fullerene solution, with the base oil.

[7] A lubricating oil composition produced by the method for producing a lubricating oil composition as described in any one of [1] to [6], the lubricating oil composition including a base oil and fullerene.

Advantageous Effects of Invention

According to the present invention, a lubricating oil composition that improves abrasion resistance, and a method for producing the same can be provided.

DESCRIPTION OF EMBODIMENTS

Hereinafter, embodiments of a lubricating oil composition, to which the present invention has been applied, and a method for producing the lubricating oil composition will be described.

The present embodiment is to specifically describe the gist of the invention for better understanding thereof and is not intended to limit the present invention, unless particularly stated otherwise.

[Lubricating Oil Composition]

The lubricating oil composition of the present embodiment includes a base oil and fullerene and is obtained by heat-treating a mixture of a base oil and fullerene in a method for producing a lubricating oil composition of the present embodiment that will be described later.

(Base Oil)

The base oil included in the lubricating oil composition of the present embodiment is not particularly limited, and usually, mineral oils and synthetic oils that are widely used as base oils for lubricating oils, are suitably used.

A mineral oil to be used as a lubricating oil is generally an oil that has been converted to a saturated hydrocarbon by saturating the double bonds contained in the oil by hydrogenation. Examples of such a mineral oil include paraffinic base oils and naphthenic base oils.

Examples of a synthetic oil include a synthetic hydrocarbon oil, an ether oil, and an ester oil. Specifically, a poly-α-olefin, a diester, a polyalkylene glycol, a poly-alpha-olefin, a polyalkyl vinyl ether, polybutene, isoparaffin, an olefin copolymer, an alkylbenzene, an alkylnaphthalene, diisodecyl adipate, a monoester, a dibasic acid ester, a tribasic ester acid ester, a polyol ester (trimethylolpropane caprylate, trimethylolpropane pelargonate, pentaerythritol 2-ethylhexanoate, pentaerythritol pelargonate, or the like), a dialkyl diphenyl ether, an alkyl diphenyl sulfide, a polyphenyl ether, a silicone lubricating oil (dimethylsilicone or the like), a perfluoropolyether, and the like are suitably used. Among these, a poly α-olefin, a diester, a polyol ester, a polyalkylene glycol, and a polyalkyl vinyl ether are more suitably used.

These mineral oils and synthetic oils may be used singly, or two or more selected from these may be used as a mixture at any arbitrary ratio.

(Fullerene)

Regarding the fullerene included in the lubricating oil composition of the present embodiment, the structure and the production method are not particularly limited, and various compounds can be used. Examples of the fullerene include $C_{60}$ and $C_{70}$, which are relatively easily available, fullerenes of higher order, and mixtures thereof. Among fullerenes, $C_{60}$ and $C_{70}$ are preferred from the viewpoint of the magnitude of solubility in lubricating oil, and $C_{60}$ is more preferred from the viewpoint that less coloring of the lubricating oil occurs. In the case of a mixture, it is preferable that $C_{60}$ is included in an amount of 50% by mass or more.

In the lubricating oil composition of the present embodiment, the concentration of fullerene after the heat treatment in the fullerene solution including a base oil and fullerene becomes lower than the concentration of fullerene before the heat treatment during the production process.

(Additives)

The lubricating oil composition of the present embodiment may include additives in addition to the base oil and the fullerene, to the extent that the effects of the present embodiment are not impaired.

The additives to be incorporated to the lubricating oil composition of the present embodiment are not particularly limited. Examples of the additives include an oxidation inhibitor, a viscosity index improver, an extreme pressure additive, a detergent dispersant, a pour point depressant, a corrosion inhibitor, a solid lubricant, an oiliness improver, a rust preventive additive, a demulsifier, a defoaming agent, and a hydrolysis inhibitor, all of which are commercially available. These additives may be used singly, or two or more kinds thereof may be used in combination.

As the additives, those having an aromatic ring are more preferred.

Examples of an oxidation inhibitor having an aromatic ring include dibutylhydroxytoluene (BHT), butylhydroxyanisole (BHA), 2,6-di-tert-butyl-p-cresol (DBPC), a 3-arylbenzofuran-2-one (an intramolecular cyclic ester of a hydroxycarboxylic acid), phenyl-α-naphthylamine, a dialkyldiphenylamine, and benzotriazole.

Examples of a viscosity index improver having an aromatic ring include a polyalkylstyrene and a hydride additive of a styrene-diene copolymer.

Examples of an extreme pressure additive having an aromatic ring include dibenzyl disulfide, an allyl phosphoric acid ester, an allyl phosphorous acid ester, an amine salt of an allyl phosphoric acid ester, an allyl thiophosphoric acid ester, an amine salt of an allyl thiophosphoric acid ester, and naphthenic acid.

Examples of a detergent dispersant having an aromatic ring include a benzylamine succinic acid derivative and an alkylphenolamine.

Examples of a pour point depressant having an aromatic ring include a chlorinated paraffin-naphthalene condensate, a chlorinated paraffin-phenol condensate, and a polyalkylstyrene-based compound.

Examples of a demulsifier having an aromatic ring include an alkylbenzene sulfonic acid salt.

Examples of a corrosion inhibitor having an aromatic ring include a dialkylnaphthalene sulfonic acid salt.

The lubricating oil composition of the present embodiment is a lubricating oil composition produced by the method for producing a lubricating oil composition that will be described below.

According to the lubricating oil composition of the present embodiment, since the lubricating oil composition includes a base oil and fullerene and is formed by being heat-treated, an effect of reducing the frictional resistance can be expected, and at the same time, the abrasion resistance can be improved.

The lubricating oil composition of the present embodiment can be used for various use applications such as industrial gear oil; hydraulic oil; compressor oil; refrigerating machine oil; cutting oil; plastic working oils such as rolling oil, pressing oil, forging oil, raising oil, drawing oil, and punching oil; metal working oils such as heat treatment oil and electric discharge machining oil; sliding guide surface oil; bearing oil; rust preventive oil; and heating medium oil.

(Production Method)

The method for producing a lubricating oil composition according to the present embodiment is a method for producing the lubricating oil composition according to the present embodiment described above, the method including a step of mixing a base oil and fullerene, dissolving a soluble component of the fullerene in the base oil, and obtaining a mixture of the base oil and the fullerene (hereinafter, referred to as "first step"); a step of removing an insoluble component included in the mixture and obtaining a fullerene solution (hereinafter, referred to as "second step"); and a step of heat-treating the fullerene solution (hereinafter, referred to as "third step"). Furthermore, the method for producing a lubricating oil composition of the present embodiment may also include, after the second step or after the third step, a step of diluting the lubricating oil composition thus obtained, with the base oil (hereinafter, referred to as "fourth step"), in order to obtain a lubricating oil composition having a desired concentration of fullerene.

Hereinafter, the method for producing a lubricating oil composition of the present embodiment will be described in detail.

(First Step)

The fullerene as a raw material is introduced into a base oil, and the mixture is subjected to a dispersing treatment using dispersing means such as a stirrer, for 3 hours to 48 hours at about room temperature or while heating the mixture as necessary.

The feed amount of the fullerene as a raw material is adjusted to be, for example, 1.2 times to 5 times, and more preferably 1.2 times to 3 times, the amount of fullerene with which a desired concentration of fullerene is obtainable with respect to the base oil according to calculations, in consideration of the fullerene concentration of the lubricating oil composition that is wished to be finally prepared. When the feed amount is less than 1.2 times, the amount of the soluble component that can be extracted is small, and there is a possibility that the desired fullerene concentration may not be satisfied. When the feed amount is greater than 5 times, in the second step of removing an insoluble component, a decrease in the filtration rate occurs in the middle of filtering, and the execution time is lengthened. Furthermore, the raw material cost for the fullerene increases.

Examples of the dispersing means for dispersing fullerene in the base oil include a stirrer, an ultrasonic dispersing device, a homogenizer, a ball mill, and a bead mill.

(Second Step)

The mixture obtained in the first step includes, as insoluble components, aggregates of fullerene and undissolved fullerene, which are impurities originating from the raw material fullerene, impurities of the base oil, and particles incorporated in the production process. Therefore, when the mixture is used as received, there may be a problem that a sliding part or the like that is in contact with the lubricating oil composition is abraded, or the like. Thus, after the first step, a second step of removing an insoluble component is provided, and a fullerene solution from which an insoluble component has been removed (hereinafter, may be simply referred to as "fullerene solution") is obtained.

In the fullerene solution described above, it is preferable that the concentration of fullerene is from 1 ppm by mass (0.0001% by mass) to 10,000 ppm by mass (1.0% by mass), it is more preferable that the concentration is from 1 ppm by mass (0.0001% by mass) to 100 ppm by mass (0.01% by mass), and it is even more preferable that the concentration is from 5 ppm by mass (0.0005% by mass) to 50 ppm by mass (0.005% by mass).

When the concentration of fullerene is in the above-described range, an effect of improving the abrasion resistance brought by addition of fullerene can be maintained for a long time period. Furthermore, it is possible to compensate for a decrease in the concentration of fullerene caused by deterioration of fullerene or the like.

Examples of the second step include: (1) a removal step of using a membrane filter; (2) a removal step of using a centrifugal separator; and (3) a removal step of using a combination of a membrane filter and a centrifugal separator. Among these removal steps, from the point of the filtration time, in a case in which a small amount of the lubricating oil composition is to be obtained, (1) a removal step of using a membrane filter is preferred; and in a case in which a large amount of the lubricating oil composition is to be obtained, (2) a removal step of using a centrifugal separator is preferred.

In the (1) removal step of using a membrane filter, for example, the mixture of the base oil and fullerene obtained in the first step is filtered using a filter with a small mesh size (for example, a 0.1-μm to 1-μm mesh membrane filter) and is collected as a fullerene solution.

In order to attempt shortening of the filtration time, for example, it is preferable to perform suction filtration.

In the (2) removal step of using a centrifugal separator, for example, the mixture of the base oil and fullerene obtained in the first step is subjected to a centrifugation treatment, and the supernatant is collected as a fullerene solution.

(Third Step)

The fullerene solution obtained in the second step is heat-treated, and a lubricating oil composition is obtained. In addition, before the third step, a fourth step of diluting the fullerene solution obtained in the second step with the base oil is carried out, subsequently the fullerene solution after being diluted in the third step is heat-treated, and the lubricating oil composition may be obtained.

Since the fullerene solution obtained in the second step is exposed to the atmosphere in the first step and the second step, the internal oxygen concentration is in an equilibrium state with oxygen in the atmosphere. Therefore, it is preferable that the third step includes an operation of lowering the oxygen concentration in the mixture compared to the oxygen concentration in a state in which the mixture is left to stand in the atmosphere.

Specifically, it is preferable that the oxygen concentration in the mixture is adjusted to 10 ppm by mass or less, more preferably to 5 ppm by mass or less, and even more preferably to 1 ppm by mass or less.

Subsequently, the fullerene solution in which the oxygen concentration has been lowered is heat-treated without being exposed to the atmosphere again.

In the third step, it is preferable to lower the oxygen concentration as described above before the heat treatment. As a more preferable method for lowering the oxygen concentration, for example, the following four methods may be mentioned.

A first method will be described.

The fullerene solution obtained in the second step is accommodated in a container made of a metal such as stainless steel, which is airtightly sealable, and then the container is tightly sealed.

Next, the container is purged with an inert gas such as nitrogen gas or argon gas, or the fullerene solution in the container is bubbled with an inert gas, and thereby the fullerene solution i brought into an equilibrium state with the inert gas.

Next, the fullerene solution is heat-treated by heating the container while maintaining the equilibrium state between the fullerene solution and the inert gas.

In the first method, the heat treatment of the fullerene solution is carried out in a low-oxygen atmosphere by heating the container while maintaining the equilibrium state between the fullerene solution and the inert gas.

The second method will be described.

The fullerene solution obtained in the second step is accommodated in a container made of a metal such as stainless steel, which is airtightly sealable, and then the container is tightly sealed.

Next, the pressure in the container is reduced, and thereby the oxygen concentration in the fullerene solution is lowered.

Next, the fullerene solution is heat-treated by heating the container while maintaining the state in which the oxygen concentration in the fullerene solution has been reduced.

In the second method, the heat treatment of the fullerene solution is carried out in a low oxygen atmosphere by heating the container while maintaining the state in which the oxygen concentration in the fullerene solution has been lowered.

The third method will be described.

The fullerene solution obtained in the second step is accommodated in a container made of a metal such as stainless steel, which is airtightly sealable, and then the container is tightly sealed.

Next, the pressure in the container is reduced, and thereby the oxygen concentration in the fullerene solution is lowered.

Next, the container is purged with an inert gas such as nitrogen gas, or the fullerene solution in the container is further bubbled with an inert gas, and thereby the fullerene solution is brought into an equilibrium state with the inert gas.

Next, the fullerene solution is heat-treated by heating the container while maintaining the equilibrium state between the fullerene solution and the inert gas.

In the third method, the heat treatment of the fullerene solution is carried out in a low oxygen atmosphere by heating the container while maintaining the equilibrium state between the fullerene solution and the inert gas.

The fourth method will be described.

The fullerene solution obtained in the second step is accommodated in an airtight container including a compression device such as a compression/cooling compressor and a driving device, and then the container is sealed.

Next, the container is filled with a Freon gas (F134A, F22, or the like), a hydrocarbon gas (isobutane), ammonia, or the like.

Next, the fullerene solution is heat-treated by heating the container.

In the fourth method, a heat treatment of the fullerene solution is carried out in a low oxygen atmosphere by heating the container while maintaining the state in which the container is filled with a Freon gas, a hydrocarbon gas, ammonia, an inert gas (nitrogen gas, argon gas, or the like), or the like.

As the heating temperature of the fullerene solution is higher, the heating time is shortened. However, when the heating temperature is too high, the components of the base oil evaporate, or the base oil is deteriorated or denatured.

Therefore, the upper limit of the heating temperature for the fullerene solution is the upper limit of the temperature at which excessive reduction of the weight of the fullerene solution caused by evaporation of the base oil does not occur. However, even if the temperature is exceeded, in a case in which an operation of collecting evaporated components with a cooling tube or the like and returning the components to the base oil is carried out, or in a case in which a heat treatment is performed in a pressure vessel in a state in which evaporation is suppressed by applying pressure, the heating temperature of the fullerene solution can be made higher than the temperature at which the base oil evaporates.

The heating temperature of the mixture is preferably from 100° C. to 250° C., more preferably from 100° C. to 150° C., and even more preferably from 120° C. to 150° C.

As the heating temperature of the fullerene solution is lower, the heating time is lengthened.

When the heating temperature is 100° C. or higher, an enhancement in the lubricating effect of the lubricating oil composition is observed. In a case in which a lubricating oil composition is manufactured industrially, the heating temperature for the fullerene solution is more preferably 100° C. or higher, and more preferably 120° C. or higher.

As the heating temperature is higher, the heat treatment of the fullerene solution proceeds faster, and thus the heating time is shortened.

As the oxygen concentration in the fullerene solution is higher, thermal deterioration of the base oil proceeds during the heat treatment of the fullerene solution, and therefore, the lubricating effect of the lubricating oil composition is not easily enhanced. When the oxygen concentration in the fullerene solution is high, the base oil is deteriorated due to oxidation during the heat treatment of the fullerene solution. As a result, the base oil may be colored, the viscosity of the base oil may be increased or decreased, or the amount of volatile component may be increased so as to increase volatility and to reduce the lubricity as a lubricating oil.

Meanwhile, when the fullerene solution comes into contact with the atmosphere for 10 minutes or longer, the oxygen concentration in the fullerene solution is brought closer to the concentration in an equilibrium state with the atmosphere. When such a fullerene solution is heat-treated, deterioration attributed to oxidation of the base oil occurs, and therefore, the abrasion resistance of the lubricating oil composition is decreased. That is, as the oxygen concentration in the fullerene solution is lower, thermal deterioration of the base oil is suppressed, and the abrasion resistance of the lubricating oil composition is enhanced. It is preferable that the oxygen concentration in the fullerene solution is lower than the oxygen concentration in the fullerene solution in an equilibrium state with the atmosphere, and it is more preferable that the oxygen concentration is 1/10 or less of the oxygen concentration in the atmosphere. Specifically, it is preferable to adjust the oxygen concentration in the fullerene solution to 10 ppm by mass or less, more preferably to 5 ppm by mass or less, and even more preferably to 1 ppm by mass or less.

The oxygen concentration in the fullerene solution can be measured using a dissolved oxygen meter. Meanwhile, in a case in which the oxygen concentration is low, since it is industrially difficult to accurately measure the oxygen concentration, the oxygen concentration in the fullerene solution is adjusted to a predetermined range by adjusting the production conditions.

In the third step, the concentration of fullerene in the lubricating oil composition obtained after the heat treatment becomes lower than the concentration of fullerene in the fullerene solution before the heat treatment.

It is considered that such a decrease in the concentration indicates that fullerene undergoes a certain reaction, and a reaction product other than the fullerene is generated thereby. It is speculated that since the reaction product is generated, the abrasion resistance of the lubricating oil composition thus obtainable is enhanced.

The concentration of fullerene in the fullerene solution before the heat treatment and the concentration in the lubricating oil composition immediately after the heat treatment can be measured by a technique of using High Performance Liquid Chromatography (HPLC), which will be described in the Examples.

The amount of fullerene lost by the heat treatment of the fullerene solution can be calculated from the difference between the concentrations of fullerene before and after the heat treatment, that is, difference between the concentrations of fullerene before and after the heat treatment=[fullerene concentration before the heat treatment]-[fullerene concentration after the heat treatment].

The concentration difference is preferably 1 ppm by mass or more, more preferably 5 ppm by mass or more, and even more preferably 10 ppm by mass or more. That is, in a fullerene solution having a fullerene content of 10 ppm by mass or less, fullerene may not be detected due to the heat treatment. Furthermore, even in a case in which the content of fullerene exceeds 10 ppm by mass, when the heat treatment is continued, the amount of loss of fullerene may exceed 10 ppm by mass, and therefore, fullerene may not be detected.

When the amount of loss of fullerene is 1 ppm or more, the abrasion resistance of the lubricating oil composition can be enhanced.

In a case in which the amount of loss of fullerene has exceeded 500 ppm by mass, or even if the amount of loss is less than or equal to that, the heat treatment can be continued even after a state in which no more disappearing fullerene remains has been reached. However, it is more difficult for the abrasion resistance of the lubricating oil composition thus obtainable to be further enhanced when the heat treatment time is divided. Therefore, the amount of loss of fullerene is preferably 500 ppm by mass or less, more preferably 100 ppm by mass or less, and even more preferably 50 ppm by mass or less.

In order to determine the heat treatment conditions for the fullerene solution, the fullerene solution in a heated state is sampled at regular time intervals using the apparatus used in Example 1 that will be described below, the concentration of fullerene included in the solution is quantitatively determined, and a graph (calibration curve) showing the relationship between the concentration of fullerene in the fullerene solution and the heating time of the mixture is produced. From this graph, the heating temperature and the heating time for the fullerene solution can be determined.

(Fourth Step)

Furthermore, after the second step or the third step, in order to measure the fullerene concentration in the fullerene solution or the lubricating oil composition obtained in the second step or the third step and to obtain a lubricating oil composition having a desired fullerene concentration, a fourth step of diluting the mixture obtained in the second step or the third step with the base oil may be included.

Regarding the base oil used in the fourth step, a base oil of the same kind as the base oil used in the first step, or a base oil of different kind may be used.

The concentration of fullerene in the fourth step can be measured by a technique of using high performance liquid chromatography (HPLC).

According to the method for producing a lubricating oil composition of the present embodiment, a lubricating oil composition capable of enhancing abrasion resistance is obtained.

As described above, preferred embodiments of the present invention have been described in detail; however, the present invention is not limited to particular embodiments, and various alterations and modifications are allowed within the scope of the gist of the present invention described in the claims.

EXAMPLES

Hereinafter, the present invention will be more specifically described by way of Examples and Comparative Examples; however, the present invention is not intended to be limited to the following Examples.

Example 1

(Preparation of Lubricating Oil Composition)

50 g of mineral oil (product name: Diana Fresia U-46, manufactured by Idemitsu Kosan Co., Ltd.) as a base oil, and 0.003 g (30 mg) of a fullerene raw material (nano™ mix ST manufactured by Frontier Carbon Corporation, a mixture of $C_{60}$: 60% by mass and $C_{70}$: 25% by mass, with the balance being other higher fullerenes) were mixed, and the mixture was stirred for 36 hours at room temperature using a stirrer.

Next, the mixture was filtered through a 0.1-μm mesh membrane filter, and thereby a fullerene solution was obtained. For the fullerene solution thus obtained, the concentration of fullerene was measured by an HPLC method, and it was confirmed to be 412 ppm by mass.

Next, the fullerene solution was diluted with the same mineral oil as the base oil, and thereby a fullerene solution X having a fullerene concentration of 10 ppm by mass was obtained.

Next, the fullerene solution X was transferred into a 250-mL four-necked pear-shaped flask, a Liebig cooling tube was attached to a first port, a silicon septum cap was attached to a second port, a nitrogen inlet tube was attached to a third port, and a detection unit of an oxygen concentration meter (product name: B-506, manufactured by Iijima Electronics Corporation) was attached to a fourth port.

Here, the concentration of oxygen dissolved in the lubricating oil fullerene solution X was measured by the following procedure.

First, 100 mL of n-dodecane (manufactured by Wako Pure Chemical Industries, Ltd.) was taken out in advance into a 250-mL beaker and was bubbled with air for 10 minutes.

Next, the oxygen concentration in this solution was set as a reference (saturation degree: 100%) using a dissolved oxygen meter.

Next, for the fullerene solution X in the four-necked pear-shaped flask, the saturated oxygen concentration was measured. As a result, the saturated oxygen concentration was 70%.

Next, the saturated oxygen concentration of dodecane in air was set to 73 ppm by mass, and from this value and the aforementioned 70%, the dissolved oxygen concentration in the fullerene solution X was calculated to be 51 ppm by mass.

Next, nitrogen was injected into the flask at a flow rate of 1 L per minute through a nitrogen inlet tube, and the flask was left to stand in that state for 10 minutes. Thereby, the interior of the flask was changed to a nitrogen atmosphere.

Next, the saturated oxygen concentration of the dissolved oxygen meter was measured. As a result, the saturated oxygen concentration was 3% (the dissolved oxygen concentration was 2.2 ppm by mass).

Next, in this state, the pear-shaped flask was immersed in an oil bath at 150° C., and the fullerene solution X was heated.

Thereafter, a needle was thrusted at the septum cap with a glass syringe at the time interval described in Table 1, and about 10 mL of the lubricating oil composition X was collected.

Meanwhile, regarding the measurement of the concentration of the fullerene, the amount of fullerene in a sample such as a lubricating oil composition was quantitatively determined by using a high performance liquid chromatograph (1200 series manufactured by Agilent Technologies, Inc.), a column manufactured by YMC Co., Ltd., YMC-Pack ODS-AM (150 mm×4.6), and a developing solvent: a 1:1 (volume ratio) mixture of toluene and methanol, and detecting the absorbance (wavelength: 309 nm). The calibration curve was produced using the fullerene raw materials described above.

In this Example 1, the concentration of fullerene in the fullerene solution X was 10 ppm by mass.

(Evaluation of Abrasion Resistance)

For the lubricating oil composition thus obtained, abrasion resistance was evaluated using a friction abrasion tester (product name: ball-on-disk tribometer, manufactured by Anton Paar GmbH).

The material for the substrate and the ball was high carbon chromium bearing steel SUJ2. The diameter of the ball was 6 mm.

The lubricating oil composition was applied on one principal plane of the substrate.

Next, the ball was slid on one principal plane of the substrate, with the lubricating oil composition being disposed therebetween, such that the ball drew concentric orbits. The speed of the ball on one principal plane of the substrate was set to 50 cm/sec, and the load exerted by the ball on the one principal plane of the substrate was set to 25 N. The scraped surface (circular in shape) of the ball surface when the sliding distance of the ball on one principal plane of the substrate added up to 1500 m was observed with an optical microscope, and the diameter of the scraped surface was measured. The results are shown in Table 1.

Example 2

A lubricating oil composition of Example 2 was prepared in the same manner as in Example 1, except that the concentration of fullerene in the fullerene solution X was changed to 52 ppm by mass.

The abrasion resistance of the lubricating oil composition of Example 2 was evaluated in the same manner as in Example 1. The results are shown in Table 1.

Example 31

A lubricating oil composition of Example 3 was prepared in the same manner as in Example 1, except that the concentration of fullerene in the fullerene solution X was changed to 107 ppm by mass.

The abrasion resistance of the lubricating oil composition of Example 3 was evaluated in the same manner as in Example 1. The results are shown in Table 1.

Comparative Example 1

A lubricating oil composition of Comparative Example 1 was prepared in the same manner as in Example 1, except that only the base oil used in Example 1 was used instead of the fullerene solution X (fullerene concentration: 0 ppm by mass).

The dissolved oxygen concentration of the lubricating oil composition was measured by a method similar to Example 1, and as a result, the dissolved oxygen concentration was 43 ppm by mass.

The abrasion resistance of the lubricating oil composition of Comparative Example 1 was evaluated in the same manner as in Example 1. The results are shown in Table 1.

Example 4

A lubricating oil composition of Example 4 was prepared in the same manner as in Example 1, except that the interior of the flask was kept not in a nitrogen atmosphere but in an air atmosphere.

The abrasion resistance of the lubricating oil composition of Example 4 was evaluated in the same manner as in Example 1. The results are shown in Table 1.

TABLE 1

| | | | Heat treatment time [hr] | | | | | | | | | |
|---|---|---|---|---|---|---|---|---|---|---|---|---|
| | | | 0 | | 0.5 | | 1 | | 3 | | 6 | |
| | Fullerene concentration [ppm by mass] | Atmosphere | Scraped surface diameter [mm] | Residual amount of fullerene [ppm by mass] | Scraped surface diameter [mm] | Residual amount of fullerene [ppm by mass] | Scraped surface diameter [mm] | Residual amount of fullerene [ppm by mass] | Scraped surface diameter [mm] | Residual amount of fullerene [ppm by mass] | Scraped surface diameter [mm] | Residual amount of fullerene [ppm by mass] |
| Example 1 | 10 | Nitrogen | 230 | 10 | 215 | 3 | 200 | 0 | 190 | 0 | 205 | 0 |
| Example 2 | 52 | Nitrogen | 230 | 52 | 220 | 47 | 200 | 22 | 210 | 2.7 | 205 | 0 |
| Example 3 | 107 | Nitrogen | 230 | 107 | 220 | 85 | 215 | 64 | 220 | 16 | 205 | 0 |
| Comparative Example 1 | 0 | Nitrogen | 280 | 0 | | | | | | | | |
| Example 4 | 52 | Air | 230 | 52 | 220 | 40 | 220 | 27 | 230 | 19 | 250 | 0 |

From the results shown in Table 1, it was found that in Comparative Example 1 that did not include fullerene, the substrate was significantly shaved compared to the state before the heat treatment.

In contrast, in Example 1 to Example 4 that included fullerene, it was found that the substrate could be prevented from being shaved even before the heat treatment.

Furthermore, when Comparative Example 1 is compared with Example 1 to Example 4, it is speculated that in Example 1 to Example 4 that included fullerene, the abrasion resistance was enhanced as a result of a decrease in the concentration of fullerene caused by the heat treatment.

In Example 1, Example 2, and Example 4, in a case in which the heat treatment time was 6 hours, the concentration of fullerene became zero, the diameter of the scraped surface was 250 mm, and the substrate was shaved more than the case of before the heat treatment (heat treatment time: 0 hours). This is speculated that because the heat treatment time was long, the thermal deterioration of the base oil exerted some influence.

The abrasion resistance of the lubricating oil composition of Example 6 was evaluated in the same manner as in Example 1. The results are shown in Table 2.

Example 71

A lubricating oil composition of Example 7 was prepared in the same manner as in Example 5, except that the concentration of fullerene in the fullerene solution X was changed to 107 ppm by mass.

The abrasion resistance of the lubricating oil composition of Example 7 was evaluated in the same manner as in Example 1. The results are shown in Table 2.

Example 8

A lubricating oil composition of Example 8 was prepared in the same manner as in Example 5, except that the interior of the flask was kept not in a nitrogen atmosphere but in an air atmosphere.

The abrasion resistance of the lubricating oil composition of Example 8 was evaluated in the same manner as in Example 1. The results are shown in Table 2.

TABLE 2

| | | | Heat treatment time [hr] | | | | | | | | | |
|---|---|---|---|---|---|---|---|---|---|---|---|---|
| | | | 0 | | 1 | | 3 | | 6 | | 12 | |
| | Fullerene concentration [ppm by mass] | Atmosphere | Scraped surface diameter [mm] | Residual amount of fullerene [ppm by mass] | Scraped surface diameter [mm] | Residual amount of fullerene [ppm by mass] | Scraped surface diameter [mm] | Residual amount of fullerene [ppm by mass] | Scraped surface diameter [mm] | Residual amount of fullerene [ppm by mass] | Scraped surface diameter [mm] | Residual amount of fullerene [ppm by mass] |
| Example 5 | 9.6 | Nitrogen | 230 | 9.6 | 230 | 10 | 225 | 10 | 210 | 8 | 195 | 5 |
| Example 6 | 54 | Nitrogen | 230 | 54 | 230 | 52 | 225 | 52 | 215 | 48 | 200 | 45 |
| Example 7 | 101 | Nitrogen | 230 | 101 | 230 | 106 | 230 | 105 | 220 | 99 | 210 | 85 |
| Comparative Example 1 | 0 | Nitrogen | 280 | 0 | | | | | | | | |
| Example 8 | 54 | Air | 230 | 54 | 230 | 54 | 220 | 54 | 220 | 52 | 225 | 51 |

However, the diameter of the scraped surface is smaller than that of Comparative Example 1 in which no heat treatment was carried out.

Example 5

A lubricating oil composition of Example 5 was prepared in the same manner as in Example 1, except that the pear-shaped flask was immersed in an oil bath at 100° C., and the fullerene solution X was heated.

In Example 5, the concentration of fullerene in the fullerene solution X was 9.6 ppm by mass.

The abrasion resistance of the lubricating oil composition of Example 5 was evaluated in the same manner as in Example 1. The results are shown in Table 2.

Example 6

A lubricating oil composition of Example 6 was prepared in the same manner as in Example 5, except that the concentration of fullerene in the fullerene solution X was changed to 52 ppm by mass.

From the results in Table 2, it is speculated that in Example 5 to Example 8 that included fullerene, the abrasion resistance was enhanced as a result of a decrease in the concentration of fullerene caused by the heat treatment.

When Example 6 is compared with Example 2, the scraped surface obtained in Example 2 with a heat treatment time of 3 hours is superior to the scraped surface obtained in Example 6 with a heat treatment time of 12 hours. That is, the heat treatment time can be shortened by increasing the temperature.

Example 9

A lubricating oil composition of Example 9 was prepared in the same manner as in Example 1, except that the pear-shaped flask was immersed in an oil bath at 120° C., and the fullerene solution X was heated.

In Example 9, the concentration of fullerene in the fullerene solution X was 10 ppm by mass.

The abrasion resistance of the lubricating oil composition of Example 9 was evaluated in the same manner as in Example 1. The results are shown in Table 3.

Example 10

A lubricating oil composition of Example 10 was prepared in the same manner as in Example 9, except that the concentration of fullerene in the fullerene solution X was changed to 52 ppm by mass.

The abrasion resistance of the lubricating oil composition of Example 10 was evaluated in the same manner as in Example 1. The results are shown in Table 3.

Example 11j

A lubricating oil composition of Example 11 was prepared in the same manner as in Example 9, except that the concentration of fullerene in the fullerene solution X was changed to 107 ppm by mass.

The abrasion resistance of the lubricating oil composition of Example 11 was evaluated in the same manner as in Example 1. The results are shown in Table 3.

Example 12J

A lubricating oil composition of Example 12 was prepared in the same manner as in Example 9, except that the interior of the flask was kept not in a nitrogen atmosphere but in an air atmosphere.

The abrasion resistance of the lubricating oil composition of Example 12 was evaluated in the same manner as in Example 1. The results are shown in Table 3.

was used as a base oil, and the pear-shaped flask was immersed in an oil bath at 250° C. so as to heat the fullerene solution X.

In Example 13, the concentration of fullerene in the fullerene solution X was 100 ppm by mass.

The abrasion resistance of the lubricating oil composition of Example 13 was evaluated in the same manner as in Example 1. The results are shown in Table 4.

Comparative Example 2

A lubricating oil composition of Comparative Example 2 was prepared in the same manner as in Example 13, except that only the base oil (fullerene concentration: 0 ppm by mass) used in Example 13 was used instead of the fullerene solution X.

The abrasion resistance of the lubricating oil composition of Comparative Example 2 was evaluated in the same manner as in Example 1. The results are shown in Table 4.

Example 14

A lubricating oil composition of Example 14 was prepared in the same manner as in Example 1, except that a polyol ester (POE) (product name: UNISTER (registered trademark) HR32, manufactured by NOF Corporation) was used as a base oil, and the pear-shaped flask was immersed in an oil bath at 150° C. so as to heat the fullerene solution X.

TABLE 31

| | | | Heat treatment time [hr] | | | | | | | |
|---|---|---|---|---|---|---|---|---|---|---|
| | | | 0 | | 1 | | 4 | | 8 | |
| | Fullerene concentration [ppm by mass] | Atmosphere | Scraped surface diameter [mm] | Residual amount of fullerene [ppm by mass] | Scraped surface diameter [mm] | Residual amount of fullerene [ppm by mass] | Scraped surface diameter [mm] | Residual amount of fullerene [ppm by mass] | Scraped surface diameter [mm] | Residual amount of fullerene [ppm by mass] |
| Example 9 | 6.7 | Nitrogen | 230 | 6.7 | 220 | 5.6 | 195 | 0 | 190 | 0 |
| Example 10 | 51 | Nitrogen | 230 | 51 | 225 | 47 | 210 | 43 | 200 | 20 |
| Example 11 | 99 | Nitrogen | 230 | 99 | 225 | 89 | 215 | 78 | 210 | 63 |
| Comparative Example 1 | 0 | Nitrogen | 280 | 0 | | | | | | |
| Example 12 | 51 | Air | 230 | 51 | 230 | 46 | 225 | 40 | 220 | 55 |

From the results in Table 3, it is speculated that in Example 9 to Example 12 that included fullerene, the abrasion resistance was enhanced as a result of a decrease in the concentration of fullerene caused by the heat treatment.

When Example 10 is compared with Example 2, the scraped surface obtained in Example 10 with a heat treatment time of 4 hours is equal to the scraped surface obtained in Example 2 with a heat treatment time of 3 hours. That is, the heat treatment time can be shortened by increasing the temperature.

Example 13

A lubricating oil composition of Example 13 was prepared in the same manner as in Example 1, except that a poly-α-olefin (PAO) (product name: SpectraSyn (registered trademark), manufactured by EXXONMOBIL Corporation)

In Example 14, the concentration of fullerene in the fullerene solution X was 100 ppm by mass. The dissolved oxygen concentration was 9 ppm by mass.

The abrasion resistance of the lubricating oil composition of Example 14 was evaluated in the same manner as in Example 1. The results are shown in Table 4.

Comparative Example 3

A lubricating oil composition of Comparative Example 3 was prepared in the same manner as in Example 14, except that only the base oil (fullerene concentration 0 ppm by mass) used in Example 14 was used instead of the fullerene solution X.

The abrasion resistance of the lubricating oil composition of Comparative Example 3 was evaluated in the same manner as in Example 1. The results are shown in Table 4.

TABLE 4

| | Fullerene concentration [ppm by mass] | Atmosphere | Heat treatment time 1 hr] 0 Scraped surface diameter [mm] | 1 Scraped surface diameter [mm] | 3 Scraped surface diameter [mm] | 6 Scraped surface diameter [mm] |
|---|---|---|---|---|---|---|
| Example 13 | 100 | Nitrogen | 240 | 200 | 191 | 198 |
| Comparative Example 2 | 0 | Nitrogen | 295 | | | |
| Example 14 | 100 | Nitrogen | 230 | 200 | 183 | 190 |
| Comparative Example 3 | 0 | Nitrogen | 310 | | | |

From the results in Table 4, it was found that in Comparative Example 2 and Comparative Example 3 that did not include fullerene, the substrate was significantly shaved.

In contrast, in Example 13 and Example 14 that included fullerene, although shaving of the substrate could be suppressed to a certain extent even before the heat treatment, the abrasion resistance was further enhanced by the heat treatment.

Example 15

(Preparation of Lubricating Oil Composition)

100 g of mineral oil (product name: TURBINE OIL 32, manufactured by JXTG Nippon Oil & Energy Corporation) as a base oil and 0.03 g (30 mg) of a fullerene raw material (nanom™ Purple manufactured by Frontier Carbon Corporation, a mixture of $C_{60}$: 99% by mass with the balance being other higher fullerenes) were mixed, and the mixture was stirred for 36 hours at room temperature with a stirrer.

Next, the mixture was filtered through a 0.1-μm mesh membrane filter, and a fullerene solution was obtained. For the fullerene solution thus obtained, the fullerene concentration was measured by an HPLC method, and it was 280 ppm by mass.

Next, the fullerene solution was transferred into a 250-mL pressure vessel made of stainless steel, nitrogen was bubbled into the fullerene solution inside the pressure vessel at a flow rate of 200 mL per minute through a nitrogen inlet tube, and the system was left to stand in that state for 60 minutes. Subsequently, the pressure vessel was covered with a stainless steel lid so that the fullerene solution and the interior of the vessel were maintained in a nitrogen atmosphere, and the interior was tightly sealed.

Next, the pressure vessel was immersed in an oil bath at 200° C., and the fullerene solution was heated for 30 minutes.

Next, the pressure vessel was taken out of the oil bath and was left to stand in the room for 60 minutes to cool.

Next, the fullerene solution inside the pressure vessel was taken out, the fullerene concentration was measured by an HPLC method, and the fullerene concentration had been decreased to 100 ppm by mass.

Next, 20 g of the fullerene solution and 80 g of mineral oil (product name: Diana Fresia P-68, manufactured by Idemitsu Kosan Co., Ltd.) were mixed, and a lubricating oil composition was obtained. Since the fullerene solution is diluted 5-fold, this corresponds to 56 ppm by mass in terms of the fullerene concentration in the state before heat treatment, and to 20 ppm by mass in terms of the residual amount of fullerene.

The abrasion resistance of the lubricating oil composition was evaluated in the same manner as in Example 1.

Comparative Example 4

A lubricating oil composition was obtained by the method of Example 15, except that the fullerene solution was not heated.

The abrasion resistance of the lubricating oil composition was evaluated in the same manner as in Example 1.

Example 16

A lubricating oil composition was obtained by the method of Example 15, except that mixing of the fullerene solution and the mineral oil was mixing of 5 g of the fullerene solution and 95 g of mineral oil (product name: Diana Fresia P-68, manufactured by Idemitsu Kosan Co., Ltd.). Since the fullerene solution is diluted 20-fold, this corresponds to 14 ppm in terms of the fullerene concentration in the state before the heat treatment, and to 5 ppm by mass in terms of the residual amount of fullerene. The abrasion resistance of the lubricating oil composition was evaluated in the same manner as in Example 1.

Comparative Example 51

A lubricating oil composition was obtained by the method of Example 16, except that the fullerene container was not heated.

The abrasion resistance of the lubricating oil composition was evaluated in the same manner as in Example 1. The results are shown in Table 5.

TABLE 5

| | Fullerene concentration [ppm by mass] | Atmosphere | Heat treatment time [hr] 0 Scraped surface diameter [mm] | 0.5 Scraped surface diameter [mm] |
|---|---|---|---|---|
| Example 15 | 56 | Nitrogen | — | 160 |
| Comparative | 56 | Nitrogen | 170 | — |

TABLE 5-continued

| | Fullerene concentration [ppm by mass] | Atmosphere | Heat treatment time [hr] 0 Scraped surface diameter [mm] | 0.5 Scraped surface diameter [mm] |
|---|---|---|---|---|
| Example 4 | | | | |
| Example 16 | 14 | Nitrogen | — | 150 |
| Comparative Example 5 | 14 | Nitrogen | 165 | — |

It was found that also in Example 15 in which the fullerene solution was subjected to a heat treatment and then was diluted with a different base oil, shaving of the substrate can be suppressed more effectively than in Comparative Example 5 in which the heat treatment was not performed.

Furthermore, when the difference between the scraped surfaces of Example 15 and Comparative Example 4 is compared with the difference between the scraped surfaces of Example 16 and Comparative Example 5, the difference is larger in the latter, and the effect of the heat treatment appears to be higher.

INDUSTRIAL APPLICABILITY

According to the present invention, abrasion resistance can be enhanced by a fullerene-containing lubricating oil composition that includes a base oil and fullerene and is formed by being heat-treated. Therefore, the present invention is effective for suppressing a metal portion from being damaged or abraded at a sliding part of an automobile, a home electric appliance, an industrial machine, or the like.

What is claimed is:

1. A method for producing a lubricating oil composition, the method comprising:

a step of mixing a base oil and fullerene, wherein the fullerene comprises a soluble component, dissolving the soluble component of the fullerene in the base oil, and obtaining a mixture of the base oil and the fullerene;

a step of removing an insoluble component included in the mixture and obtaining a fullerene solution; and a step of heat-treating the fullerene solution.

2. The method for producing a lubricating oil composition according to claim 1, wherein the step of heat-treating the fullerene solution is carried out in an atmosphere which has a lower oxygen concentration than an atmosphere in the steps prior to the step of heat-treating the fullerene solution.

3. The method for producing a lubricating oil composition according to claim 2, wherein an oxygen concentration in the fullerene solution is 10 ppm by mass or less.

4. The method for producing a lubricating oil composition according to claim 1, wherein in the step of heat-treating the fullerene solution, a heating temperature and a heating time for the fullerene solution are determined, based on a calibration curve showing a relationship between a concentration of the fullerene in the fullerene solution and the heating time for the fullerene solution, the calibration having been produced by measuring the concentration of the fullerene in the fullerene solution in a heated state at regular time intervals.

5. The method for producing a lubricating oil composition according to claim 1, wherein the fullerene is a mixture including $C_{60}$ and $C_{70}$.

6. The method for producing a lubricating oil composition according to claim 1, further comprising, after the step of removing an insoluble component or after the step of heat-treating the fullerene solution, a step of diluting the fullerene solution obtained in the step of removing the insoluble component or the lubricating oil composition obtained in the step of heat-treating the fullerene solution, with the base oil.

7. The method for producing a lubricating oil composition according to claim 2, wherein in the step of heat-treating the fullerene solution, a heating temperature and a heating time for the fullerene solution are determined, based on a calibration curve showing a relationship between a concentration of the fullerene in the fullerene solution and the heating time for the fullerene solution, the calibration having been produced by measuring the concentration of the fullerene in the fullerene solution in a heated state at regular time intervals.

8. The method for producing a lubricating oil composition according to claim 3, wherein in the step of heat-treating the fullerene solution, a heating temperature and a heating time for the fullerene solution are determined, based on a calibration curve showing a relationship between a concentration of the fullerene in the fullerene solution and the heating time for the fullerene solution, the calibration having been produced by measuring the concentration of the fullerene in the fullerene solution in a heated state at regular time intervals.

9. The method for producing a lubricating oil composition according to claim 2, wherein the fullerene is a mixture including $C_{60}$ and $C_{70}$.

10. The method for producing a lubricating oil composition according to claim 3, wherein the fullerene is a mixture including $C_{60}$ and $C_{70}$.

11. The method for producing a lubricating oil composition according to claim 4, wherein the fullerene is a mixture including $C_{60}$ and $C_{70}$.

12. The method for producing a lubricating oil composition according to claim 2, further comprising, after the step of removing an insoluble component or after the step of heat-treating the fullerene solution, a step of diluting the fullerene solution obtained in the step of removing the insoluble component or the lubricating oil composition obtained in the step of heat-treating the fullerene solution, with the base oil.

13. The method for producing a lubricating oil composition according to claim 3, further comprising, after the step of removing an insoluble component or after the step of heat-treating the fullerene solution, a step of diluting the fullerene solution obtained in the step of removing the insoluble component or the lubricating oil composition obtained in the step of heat-treating the fullerene solution, with the base oil.

14. The method for producing a lubricating oil composition according to claim 4, further comprising, after the step of removing an insoluble component or after the step of heat-treating the fullerene solution, a step of diluting the fullerene solution obtained in the step of removing the insoluble component or the lubricating oil composition obtained in the step of heat-treating the fullerene solution, with the base oil.

15. The method for producing a lubricating oil composition according to claim 5, further comprising, after the step of removing an insoluble component or after the step of heat-treating the fullerene solution, a step of diluting the fullerene solution obtained in the step of removing the insoluble component or the lubricating oil composition obtained in the step of heat-treating the fullerene solution, with the base oil.

16. The method for producing a lubricating oil composition according to claim 1, wherein the fullerene solution has a concentration of fullerene of from 1 ppm by mass to 10,000 ppm.

17. The method for producing a lubricating oil composition according to claim 1, wherein the fullerene solution has a concentration of fullerene of from 1 ppm by mass to 100 ppm.

18. The method for producing a lubricating oil composition according to claim 1, wherein the fullerene solution has a concentration of fullerene of from 5 ppm by mass to 50 ppm.

* * * * *